US005729094A

United States Patent [19]

Geis et al.

[11] Patent Number: 5,729,094

[45] Date of Patent: Mar. 17, 1998

[54] ENERGETIC-ELECTRON EMITTERS

[75] Inventors: Michael W. Geis; Jonathan C. Twichell, both of Acton; Theodore M. Lyszczarz, Concord, all of Mass.

[73] Assignee: Massachusetts Institute of Technology, Cambridge, Mass.

[21] Appl. No.: 632,026

[22] Filed: Apr. 15, 1996

[51] Int. Cl.[6] ..... H01J 19/02

[52] U.S. Cl. ..... 315/169.1; 315/169.3; 313/310; 313/311; 313/496; 257/77

[58] Field of Search ..... 315/169.1, 169.2, 315/169.3; 313/309, 310, 311, 495, 496, 497; 257/77

[56] References Cited

U.S. PATENT DOCUMENTS

| | | | |
|---|---|---|---|
| 3,105,166 | 9/1963 | Choyke et al. | 313/310 |
| 4,672,266 | 6/1987 | Taniguchi et al. | 313/509 |
| 5,202,571 | 4/1993 | Hirabayashi et al. | 257/77 X |
| 5,210,430 | 5/1993 | Taniguchi et al. | 313/509 X |
| 5,252,833 | 10/1993 | Kane et al. | 315/169.1 X |
| 5,275,967 | 1/1994 | Taniguchi et al. | 437/127 |
| 5,278,475 | 1/1994 | Jaskie et al. | 315/169.3 |
| 5,334,855 | 8/1994 | Moyer et al. | 257/77 X |
| 5,442,256 | 8/1995 | Moyer et al. | 313/496 |
| 5,473,218 | 12/1995 | Moyer | 313/309 |
| 5,552,613 | 9/1996 | Nishibayashi et al. | 257/77 X |

FOREIGN PATENT DOCUMENTS

| | | |
|---|---|---|
| 1017394 | 1/1989 | Japan . |
| 6208835 | 7/1994 | Japan . |
| 7006687 | 1/1995 | Japan . |
| 7065701 | 3/1995 | Japan . |

OTHER PUBLICATIONS

Geis, M.W. et al., "Electron field emission from . . . ", *Appl. Phys. Lett.*, 67(9), 28 Aug. 1995.

Burchard, B. et al., "Diamond based light emitting structures" *Diamond and Related Materials*, 3(1994) 947–950.

Toyama, T. et al., "Hot–electron–induced electroluminescence and . . . ", *J. App. Phys.*, 77(12), 15 Jun. 1995.

Huang, Z.–H. et al., "Monte Carlo simulation of hot electron charge Transport in Diamond Under an Internal Electric Field" *Appl. Phys. Lett.*, vol. 67, No. 9, Aug. 28, 1995.

Fitting, H.–J. et al., "Monte–Carlo Approach of Electron Emission From $SiO_2$" *Phys. Stat. Sol.* (a) 81,323 (1984).

Dimaria, D.J. et al., "Hot Electrons in Silicon Dioxide: Ballistic to Steady–State Transport", *Applied Surface Science* 30 (1987) 278–297.

Fischetti, M.V. et al., "Hot Electrons in SiO2: Ballistic to Steady–State Transport", *Solid–State Electronics*, vol. 31, No. 3/4, pp. 629–636, 1988.

DiMaria, D.J. et al., "Direct Observation of Ballistic in Silicon Dioxide", *Physical Review Letters*, vol. 57, No. 25, Dec. 1986, Am. Phys.

DiMaria, D.J. et al., "Electron heating in silicon Nitride and Silicon Oxynitride Films", *J. App. Phys.*, 60(5), 1 Sep. 1986.

Arnold, D. et al., "Theory of high–field electron Transport and Impact Ionization in Silicon Dioxide", *Physical Review B*, vol. 49, No. 15, Apr. 1994, Am. Phys. Soc.

(List continued on next page.)

*Primary Examiner*—Robert Pascal
*Assistant Examiner*—Justin P. Bettendorf
*Attorney, Agent, or Firm*—Cesari and McKenna, LLP

[57] ABSTRACT

An energetic-electron emitter providing electrons having kinetic energies on the order of one thousand electron volts without acceleration through vacuum. An average electric field of $10^5$ V/m to $10^{10}$ V/m applied across a layer of emissive cathode material accelerates electrons inside the layer. The cathode material is a high-dielectric strength, rigid-structure, wide-bandgap semiconductors, especially type Ib diamond. A light-emitting device incorporates the energetic-electron emitter as a source of excitation to luminescence.

111 Claims, 9 Drawing Sheets

OTHER PUBLICATIONS

Collins, R.A. et al., "Hot Electron Transport and Emission in Au–SiO–Au Thin Film Cathodes", *Solid–State Electronics,* Pergamon Press, 1971, 14, 805–810.
Fischetti, M.V. et al., "Ballistic electron transport in Thin Silicon Dioxide Films", *Physical Review B,* vol. 35, No. 9, Mar. 1987, Am. Phys. Soc., pp. 4404–4415.
Fitting, H.–J., "Monte Carlo calculation . . . ", *Paper presented at 2nd Int. Conf. on Vac. Micro.,* Bath, 1989, IOP Pub. Ltd.
Kitai, A.H., Ed., *Solid State Luminescence,* Chapman & Hall, New York.
Mueller, G.O. et al., "Direct Evidence of Ballistic Acceleration of Electrons in ZnS", *Int. Conf. Phys. Semicond.,* 20th (1990) 3, pp. 2510–2513.
Fitting, H.–J. et al., "Vacuum Emission of Hot Electrons from ZnS", *Phys. Stat. Sol.* (a) 121, 305(1990), pp. 305–313.
Fitting, H.–J. et al., "Avalanche Measurement in ZnS by Vacuum Emission", *Phys. Stat. Sol.* (a) 122, (1990), pp. K165–K168.
Okamoto, Shinji, et al., "Thin–Film Cold Cathode Using ZnS Layer", *Jap. Journal of App. Phys.,* 30, No. 7B, Jul. 1991, pp. L1321–L1323.
Mueller, G.O. et al., "Hot Electron Cold Cathode for CRTs, etc.", *1991 Int. Display Research Conf. Papers,* San Diego, 1991, IEEE, pp. 16–19.
Müller, G.O. et al., "High–field electron . . . ", *Journal of Crystal Growth,* 117, (1992), pp. 948–953, Elsevier Science Pub.
Okamoto, S. et al., "Single insulating thin–film cold using hot electrons in II–IV compounds", *Journal of Crystal Growth,* 117, (1992), pp. 943–947, Elsevier Pub.
Mach, R. et al., "Ballistic Transport and Electroluminescence in IIB–VI and IIA–VI Compounds", *Journal of Crystal Growth* 101, (1990), pp. 967–975, Elsevier Science Pub.
Fitting, H.–J. et al., "Ballistic Transport in Alkaline Earth Sulfides", *Journal of Crystal Growth,* 101, (1990), pp. 876–881, Elsevier Pub.
Bringuier, E., "Tentative anatomy of ZnS–type electroluminescence", *J. Appl. Phys.* 75(9), 1 May 1994, pp. 4291–4311.

ENERGETIC-ELECTRON EMITTERS

This invention was made with government support under Air Force contract no. F1962895C0002. The government has certain rights in this invention.

FIELD OF THE INVENTION

This invention relates to electron-emitting devices. More particularly, this invention relates to structures and compositions for emitting high-energy electrons.

BACKGROUND OF THE INVENTION

Field emission is a quantum-mechanical phenomenon whereby electrons in a solid tunnel through the energy barrier at an emitter/vacuum interface and are emitted into vacuum under the influence of an electric field. Cold cathodes, which function by field emission, have several attributes which make them attractive, for example, as replacements for devices traditionally incorporating thermionic emitters. In addition to avoiding the difficulties associated with incandescence, such as thermal fatigue and degradation of the cathode material and the effect of high power dissipation on the surrounding components, cold cathodes offer performance advantages such as rapid switching capability. Among the many potential applications of field emitters, cold cathode research and development has been especially oriented toward their application in vacuum microelectronics and in flat-panel display technologies.

Generally, conventional cold cathodes are operated by the application of an electric field, typically having an average value on the order of more than $10^7$ V/m, between the emissive cathode material and an anode located across an expanse of vacuum from the cathode. The emitted electrons, in thermal equilibrium with the emissive material, have little kinetic energy; after emission, they are efficiently accelerated by the applied electric field across the vacuum, achieving kinetic energies of 500 to 20,000 eV, according to the applied potential difference, before reaching the anode.

In contrast, a so-called hot-electron cold cathode (HECC) emits electrons having significant kinetic energies due to acceleration through strong electric fields within the cathode material before emission. (See, e.g., Müller et al., 1991 International Display Research Conference, Society for Information Display, October 15–17, pp. 16–19; Okamoto et al., *Japanese Journal of Applied Physics,* 30 (7B), L1321–L1323 [1991]; Dalacu et al., Applied Physics Letters, 58(6), 613–615 [1991]). Electrons in such devices are efficiently transported inside the cathode material, gaining kinetic energy by means of acceleration through a strong electric field, at a greater rate than they lose energy to collisions and other energy loss mechanisms.

Emission of electrons with energies in excess of 10 eV have been observed from HECCs in which an electric field having an average amplitude of about $10^8$ V/m is applied across a zinc sulfide cathode layer. These HECC devices include a succession of layers, generally a conductive back electrode, a high-dielectric-strength layer, the cathode-material layer of zinc sulfide, and a front electrode. In operation, the ac electric field applied across the device at the front and back electrodes accelerates electrons to sufficient kinetic energies to surmount the energetic barrier at the interface between the cathode material and the front electrode, traverse the electrode and overcome its work function to enter vacuum with kinetic energies of several electron volts.

The possibility of providing high-energy electrons falling within a predictable energetic window without acceleration through vacuum make the HECC an especially attractive and versatile type of emitter. However, there are several difficulties with known HECC devices. The strong electric field must be applied in an alternating fashion to avoid destruction of the zinc sulfide cathode material by dielectric breakdown. This polarity reversal requirement limits the HECC efficiency because the structure only emits during the intervals when the front electrode is positive with respect to the back electrode; and also precludes the incorporation of ZnS HECCs in designs requiring dc steady-state operation. Also, ZnS HECC's require the high-dielectric strength layer to provide a series capacitance that limits the transferred charge to safe values and thus controls dielectric breakdown of the cathode layer so that it is reversible and nondestructive.

Neither are zinc sulfide's emission properties ideal. Only a small part of the total current through the cathode layer is emitted, reportedly on the order of one thousandth. Also, without external acceleration after emission, the electron energies are less than would be useful for some applications. Although adjustment of other aspects of an HECC device may provide some efficiency or energy enhancement, it appears that an HECC with significantly higher efficiency or electron energies will be realized only with a different cathode material.

However, identification of such a material is not a straightforward matter. The efficient electron transport required for high-energy emission is not a general property of semiconductors. The operation of energy loss mechanisms for an electron even a few electron volts higher than its ground state is not well understood. Only a small number of materials are known to exhibit this efficient electron acceleration behavior. HECCs incorporating zinc selenide as the cathode material have been constructed, but the emitted electrons are less energetic than those emitted by zinc sulfide in the same configuration, correlating with the relative bandgap widths of zinc selenide and zinc sulfide. Calcium sulfide, gallium sulfide and strontium sulfide have also been identified in theory as allowing efficient electron acceleration, whereas several of the wide-bandgap oxides have been shown not to exhibit this behavior. (See, e.g., Müller, *Journal of Crystal Growth,* 117, 948–953 [1992]; Fitting et al, *Journal of Crystal Growth,* 101, 876–881 [1990]; Mach et al., ibid., 967–975.)

The high dielectric strength of silicon dioxide makes it worthy of consideration as cathode material for a HECC-type of device operable with dc voltage, unlike the zinc chalcogenide devices. Its wide bandgap (about 9 eV) may indicate the possibility of high emitted-electron energies. In fact, the emission of electrons having energies as high as 45 eV has been observed from silicon dioxide under an applied electric field of about $6\times10^8$ V/m. However, the emission efficiencies were very low. Also, the energy distribution of the emitted electrons was very broad, and the average emitted-electron energy was about 10 eV. (See, e.g., Fitting et al., *Phys. Stat. Sol.,* A93, 385–96 [1986].)

Diamond has received much attention as a propitious candidate for conventional cold cathodes, in spite of its relatively high cost, owing to its low, and in some cases negative, electron affinity (see, e.g., Geis et al., *IEEE Electron Device Letters,* EDL-12, 456–9 [1991]). Diamond also has the high dielectric strength and wide bandgap (about 5.5 eV) attractive for a dc-HECC device. However, Monte Carlo studies have recently predicted that under internal fields on the order of $10^8$ V/m electrons in diamond film only attain energies of a few electron volts, less than those available from known HECCs (see, e.g., Huang et al., *Applied Physics Letters,* 76(9), 1235–1237 [1995]).

DESCRIPTION OF THE INVENTION

Brief Summary of the Invention

The present invention provides an electron emitter capable of emitting electrons having kinetic energies on the order of one thousand electron volts with the application of dc electric fields having average strengths less than $10^{10}$ V/m. The emissive cathode material is a wide-bandgap semiconductor, preferably diamond. Type Ib diamond, synthesized using conventional high-pressure techniques, having at least $10^{18}$ $cm^{-3}$ substitutional nitrogen donors at a deep donor level about 1.7 eV below the conduction band edge, provides an especially favorable emitted electron energy distribution. However, the invention encompasses the use of other wide-bandgap, rigid-structure materials such as other forms of diamond and other semiconductors such as group III nitrides—including boron nitride, aluminum nitride, gallium nitride—and silicon carbide as the emissive cathode material.

In one embodiment, the cathode material is in contact with back and front electrodes. A voltage supply impresses an average electric field between the back and front electrodes having an amplitude of about $10^5$ V/m to $10^{10}$ V/m, or even greater than $10^{10}$ V/m, with the front electrode positive with respect to the back electrode. Under the influence of the applied field, electrons leave the front electrode with kinetic energies corresponding to a significant percentage of the average field strength across the thickness of the layer. This percentage may be as large as 10% or even greater. The electron energies are typically 50 eV or greater, even as great as several hundred or one thousand electron volts.

In one such emitter, type-Ib diamond, approximately 1 mm thick, is mounted on a metallic substrate serving as the back electrode. Electrical contact between the insulating cathode material and the metallic substrate is made at a rough or damaged diamond-metal interface. The front electrode is formed by graphitizing the front surface of the diamond. A dc voltage supply is connected between the front and back electrodes so that the front electrode is about 1500 volts positive with respect to the back electrode, so that an average field of about $10^6$ V/m falls across the diamond. Under the influence of the applied potential difference, electrons leave the front electrode with energies in excess of 900 eV, which corresponds to over 60% of the energy available from acceleration by the field energy across the thickness of the diamond. The emission efficiency, the ratio of the emitted high-energy electron current to the total current through the diamond cathode body, is about 1% and higher, as high as 30%. Typically, the width of the energy distribution of the emitted electrons is less than about 100 eV.

In another embodiment, the front electrode is replaced by an anode separated from the emitter material by an expanse of vacuum. In this case, the thickness of the cathode material, the cathode-anode spacing, and the voltage applied across the back electrode and the anode are such that an average electric field, of about $10^5$ V/m to $10^7$ V/m in the case of diamond, is imposed across the emitter material so that it emits energetic electrons. The emitting surface of the cathode material is optionally covered with cesium or otherwise treated to improve the energetics of electron transfer from the cathode material into the vacuum. Depending on the voltage drop across the vacuum, the emitted energetic electrons may acquire significant additional kinetic energy during acceleration through the vacuum to the anode.

The internal acceleration required to support electron emission in this energy range is completely unexpected in a solid material, whether it be diamond or any other semiconductor. Although some scattering events are known to become less efficient as electron energies increase inside the semiconductor, other energy-diminishing events such as the generation of secondary electrons are known to be enhanced, apparently limiting the ultimate acceleration attainable inside the semiconductor, before emission. The mechanism by which loss of the electron energy to such events is inhibited to allow the electron energies observed from the emitters of the invention is not completely understood. In type-Ib diamond, the high dopant concentration may give rise to conductive channels spanning much of the bulk of the crystal. If the end of a channel falls short of the emitter front surface by a length on the order of ten microns, a strong internal electrical field, supported by the high dielectric strength of the diamond, can accelerate the electron to energies on the order of 1 keV over this short distance before they traverse the front electrode. Or, the electrons may be accelerated to these energies more uniformly across the entire bulk of the crystal.

The invention provides the ability to create highly energetic electrons by applying electric fields to the cathode material that are on average an order of magnitude lower than fields previously applied to HECC devices. The high kinetic energies of the emitted electrons are sufficient for many applications without acceleration across vacuum. The relatively low electric fields coupled with high dielectric strength allow dc operation. These attributes enhance the robustness and versatility of devices incorporating these emitters.

The energetic-electron emitters of the invention are, for example, appropriate replacements for cold cathodes in flat-panel displays. The invention furthermore provides light-emitting devices in which energetic electrons leaving the cathode material pass directly into a phosphor material and excite luminescence. The high electron energies available allow the electrons to surmount the energetic barrier between the cathode and phosphor materials and eliminate the need for intermediate acceleration.

BRIEF DESCRIPTION OF THE DRAWINGS

The foregoing discussion will be understood more readily from the following detailed description of the invention, when taken in conjunction with the accompanying drawings, in which like reference numerals indicate identical or functionally similar elements.

It will be appreciated that, for purposes of illustration, these figures are not necessarily drawn to scale.

DETAILED DESCRIPTION OF THE INVENTION

Figure 1:
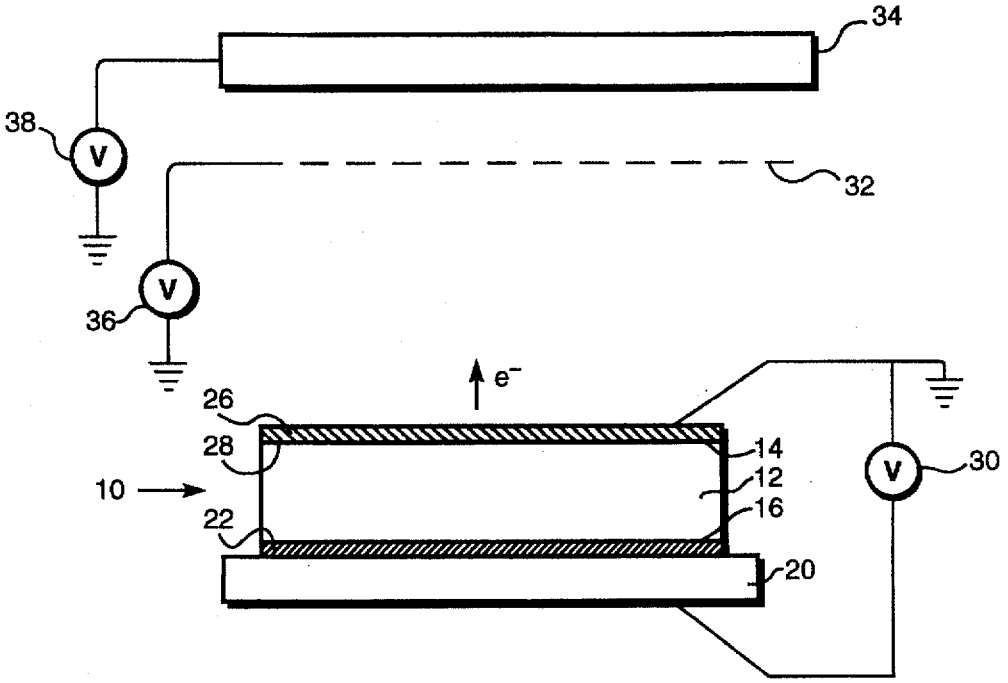
FIG. 1 schematically illustrates the structure of an electron emitter of the invention.

With reference to FIG. 1, an electron emitter of the invention, generally designated at 10, includes a layer 12 of cathode material having a front surface 14 and a back surface 16. The layer 12 is in contact with a back electrode 20 at a back interface 22. The configuration of the back electrode 20 is not limited to the planar substrate shown in the figure, but may be any conductive body in electrical communication with the layer 12 at which connection to an external voltage source may be made. The layer 12 is in contact with a front electrode 26 at a front interface 28. A voltage source 30 contacts the back and front electrodes 20 and 26 so as to allow the imposition of a potential difference between them. For some applications, the emitter 10 also includes a conductive grid 32 or anode 34 placed above the layer 12 and a respective voltage source 36 or 38 configured to apply a voltage between the front electrode 26 and the grid 32 or anode 34 for accelerating or decelerating energetic electrons emitted from the front electrode 26. The emitter 10 is optionally housed in an evacuated chamber.

In a preferred embodiment, the layer 12 of cathode material is of type Ib diamond at least 10 μm thick between its front and back surfaces 14 and 16. Generally the layer 12 is thicker than 100 μm and preferably on the order of 1 mm thick, such as between 1 and 3 mm thick. The back electrode 20 may be of any conductive material, preferably a metal. The performance of the emitter 10 is generally enhanced by a rough, or damaged, morphology of the back interface 22, as described in copending U.S. application Ser. No. 432,848, herein incorporated by reference. Because of the high resistivity of some of the wide-bandgap semiconductors used as cathode materials in the invention, the back interface 22, especially an interface having a roughness characterized by a radius of curvature less than 15 nm, between the back electrode 20 and the cathode material 12 limits the carriers available for acceleration in the cathode material; a rough back interface 22 promotes electron injection from the back electrode 20 material into the layer 12. The performance advantage conferred by the rough back interface is particularly notable for diamond, especially type-Ib diamond. The front electrode 26 is a thin conductive layer, usually no thicker than several nanometers, preferably of metal or graphite. The thickness of the front electrode 26 is generally chosen to be shorter than the mean-free electron path in the electrode material so that the electrons do not lose significant kinetic energy while passing through it. The front electrode provides complete coverage of the cathode material, or its coverage may be patterned. Methods of fabricating the electrodes 20 and 26 and the back interface 22 are discussed below.

Depending on the use of the emitter 10, the voltage source 30 may be configured to supply an ac-voltage or a dc-voltage signal. The amplitude of the applied voltage depends on the properties of the cathode material, such as its dielectric strength and the internal electric field required for high-energy electron emission, and on the thickness of the layer 12. In the case of type-Ib diamond, for example, the voltage source 30 is capable of supplying voltages that impose an average electric field of about $10^5$ V/m to $10^7$ V/m across the layer 12. FIG. 1 shows the front electrode grounded, but this is not a requirement. The voltage source is connected to the electrodes 20 and 26 so that, during the intervals when emission is desired, the front electrode 26 is at a higher potential than is the back electrode 20.

Figure 2A:
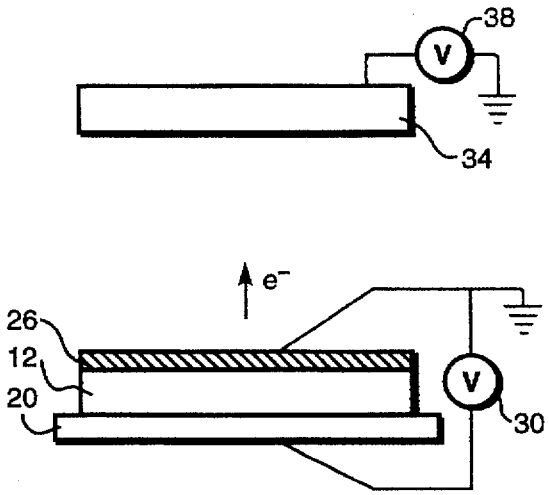
FIGS. 2A and 2B schematically illustrate test circuits for observing the behavior of the electron emitter of FIG. 1.
Figure 2B:
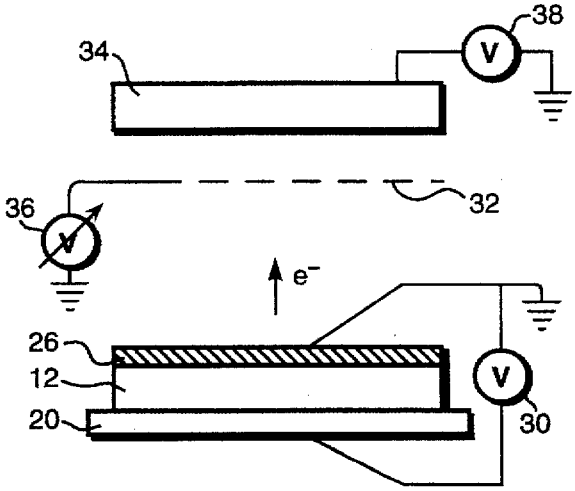
Figure 3:
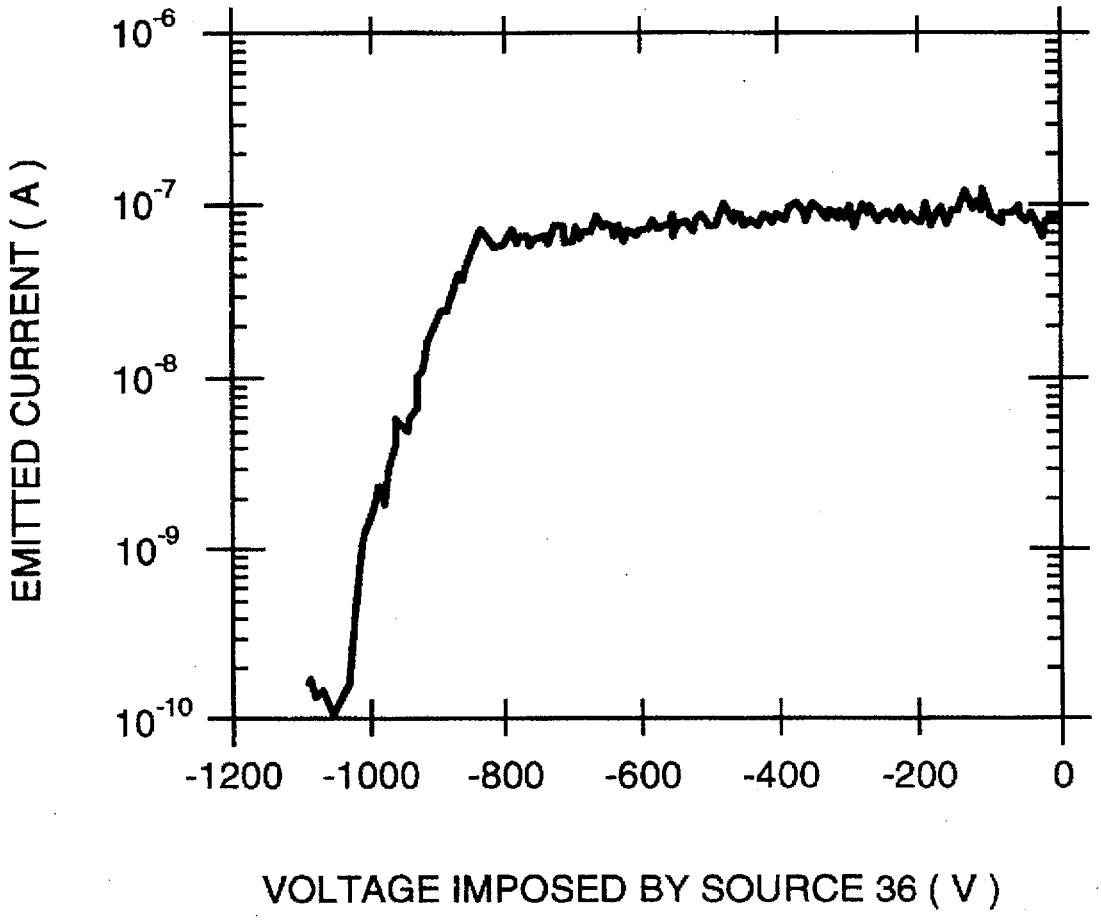
FIG. 3 graphically depicts the energy distribution of electrons emitted by the emitter of FIG. 1.

In operation, electrons are provided to the interior of the cathode layer 12, for example, by injection from the back electrode 20, or by some other means, such as generation within the cathode layer 12 by the action of radiation, such as X-rays or laser light, on the cathode material. The applied electric field accelerates electrons inside the emitter layer 12 toward the front electrode 26 to sufficient kinetic energies to overcome the energetic barrier at the front interface 28, traverse the electrode 26 and surmount its work function, and thereby leave the front electrode 26 with significant kinetic energies. For example, the graphitized front electrode 26 of an emitter 10 incorporating a type-Ib diamond 1.3 mm thick was grounded and the back electrode 20 biased to a dc negative voltage of 0 to 5000 V. The emitted current-bias voltage characteristic of the device was observed in a chamber evacuated to $10^{-7}$ Torr using the circuit configuration shown in FIG. 2A. Emitted currents collected at a phosphor-screen anode 34, held 10 V positive with respect to ground by a dc voltage source 38, were 1% to 30% of the total current through the diamond. The energy distribution of the electrons emitted by the diamond layer 12 under an applied voltage of 1500 V was measured using the circuit configuration shown in FIG. 2B. The voltage with respect to ground of a grid 32, imposed by a variable dc voltage source 36, was varied from 0 to −1100 V, to exert a retarding force on the emitted electrons. The dependence of the current at the anode 34 on the voltage provided by the source 36, shown in FIG. 3, indicates that most of the electrons have energies greater than 900 eV. The emission is invariant over time for times at least on the order of an hour.

Figure 4:
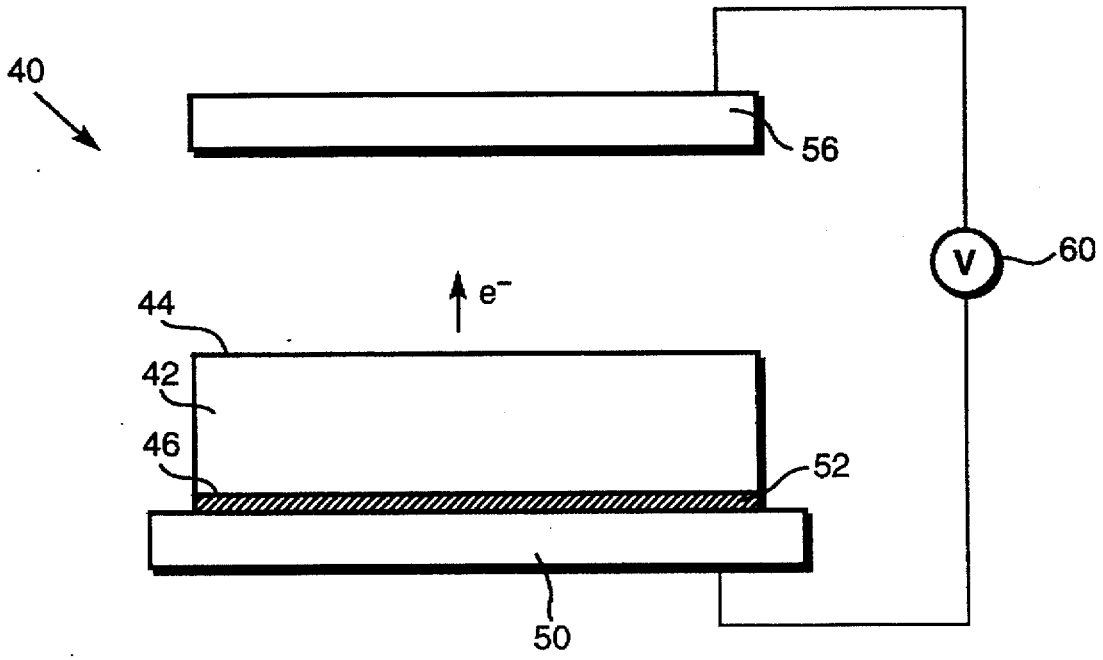
FIG. 4 schematically illustrates an electron emitter of the invention.

In another embodiment, shown in FIG. 4, an emitter of the invention, generally designated at 40, includes a layer 42 of cathode material having a front surface 44 and a back surface 46. The layer 42 is in contact with a back electrode 50 at a back interface 52. The attributes of the layer 42, the back electrode 50 and the back interface 52 correspond to those, already described, of the layer, back electrode and back interface shown in FIG. 1 and respectively designated 12, 20 and 22. The front surface 44 of the layer 42 is optionally coated with an emission-enhancing material such as cesium or otherwise treated according to conventional techniques to reduce the work function of the surface 44 (see, e.g., Brandes et al., *Diamond Related Mater.*, 4, 586 [1995]). An anode 56 opposes the front surface 44 across an expanse of vacuum. A voltage source 60 contacts the back electrode 50 and the anode 56 so as to allow the imposition of a potential difference between them. The emitter is housed in an evacuated chamber.

Considerations analogous to those already discussed for the voltage source designated 30 are relevant to configuration of the voltage source 60. In operation, the voltage source 60 effects an average electric field of about $10^5$ V/m to $10^7$ V/m across the layer 42 so that the front surface 44 emits energetic electrons, having energies corresponding to a significant percentage of the average field strength across the thickness of the layer 42. This percentage may be as large as 10% or even greater. The electrons are sometimes emitted as collimated beams, up to 45° from the normal to the surface 44, which diverse less than 100 μm after traversing 1 cm. This behavior is especially associated with a lack of treatment of the front surface 44. A cesium-treated front surface 44 generally emits a diffuse beam of electrons.

The potential drop between the front surface 44 and the anode 56 may then provide additional acceleration of the emitted elections. Although emitted electrons may experience very large electric fields across the vacuum, generally the applied voltage drops across the emitter 40 such that the average electric field across the layer 42 is roughly at least equal to, and often equal to several times, the average field across the vacuum; thus, the acceleration undergone within the layer 42 provides a significant percentage, estimated to be as great as 20% or more, of the kinetic energy of the emitted electrons reaching the anode 56. In this case, energetic emission by the emitter 40 is distinguishable from emission by a similarly configured field emitter by the effect of the distance between the front surface 44 and the anode 56 on the behavior of the emitted current.

Figure 5:
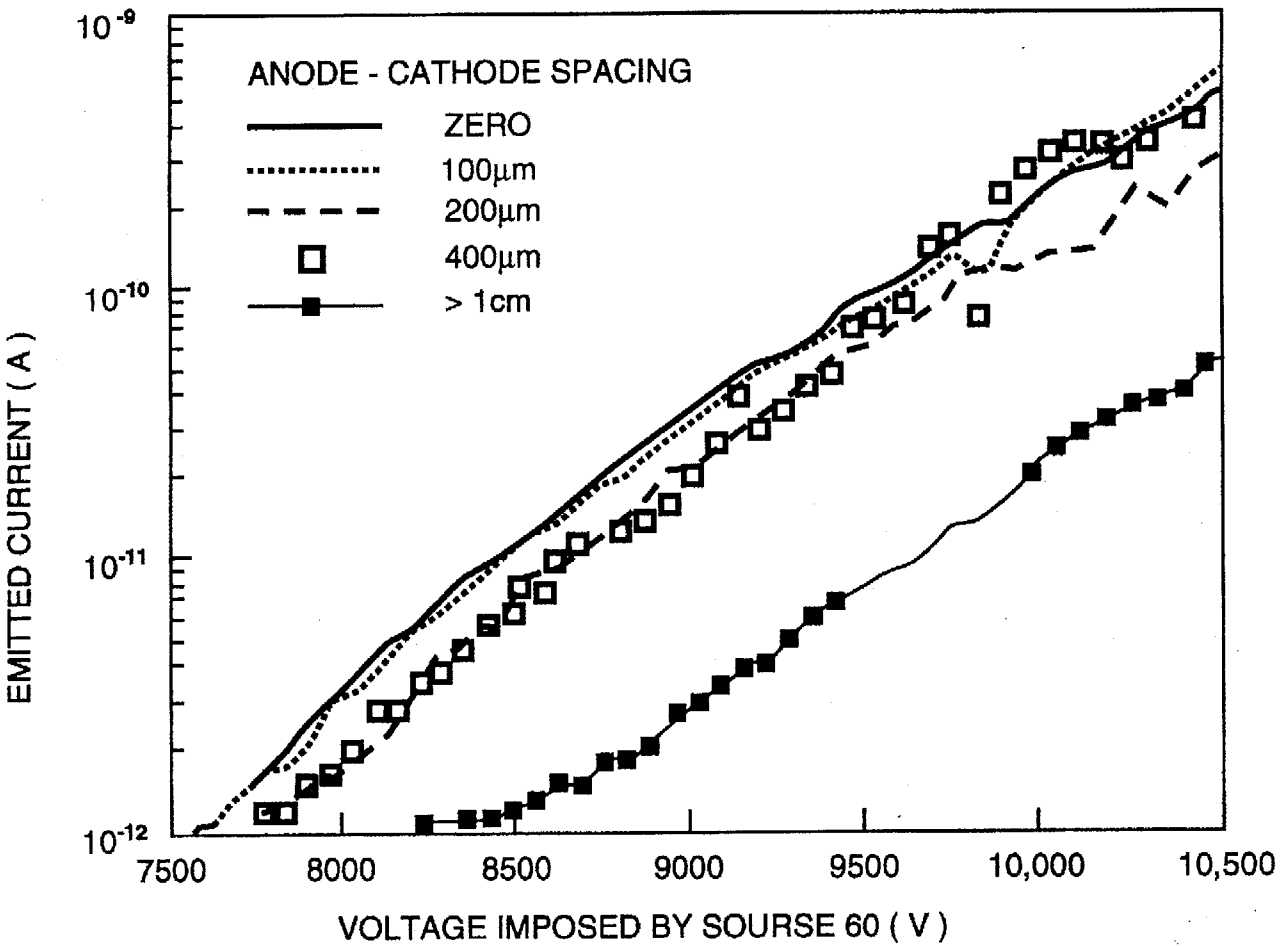
FIG. 5 graphically depicts the current-voltage characteristics of the electron emitter of FIG. 4.
Figure 6:
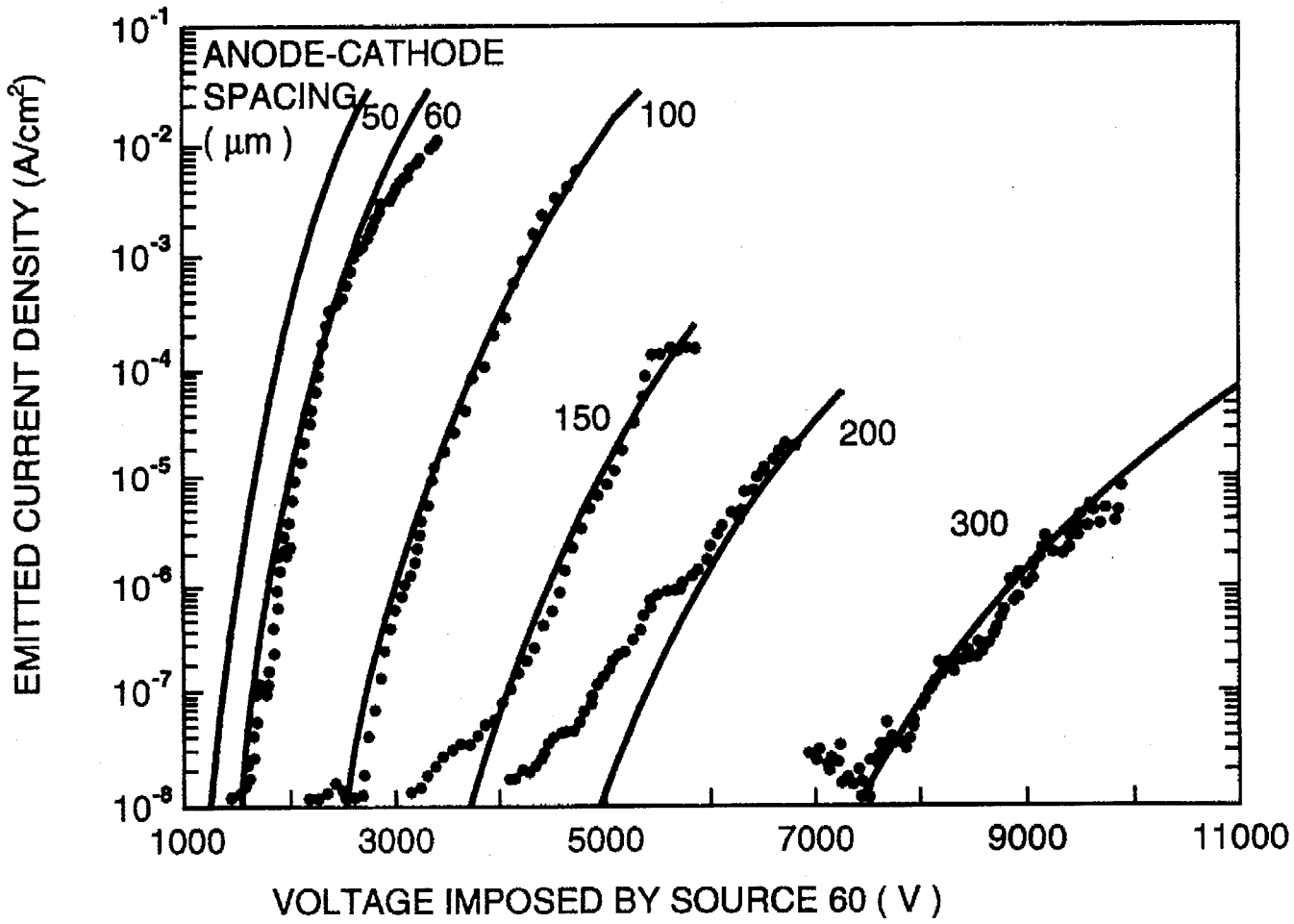
FIG. 6 graphically depicts the current-voltage characteristics of a field emitter.

For an emitter 40 having a polished and cleaned type-Ib diamond roughly 1.3 mm thick and 3 mm wide as the layer 42 and a molybdenum cylinder 1 mm in diameter as the anode 56, the average electric field strength is about $7\times10^6$ V/m across the layer 42 and $2\times10^5$ V/m across the vacuum for one exemplary value of the current. For this emitter, the current-voltage characteristic, shown in FIG. 5, is relatively insensitive to the anode-cathode spacing for distances smaller than the lateral dimension of the diamond. The strength of the field across the vacuum does not significantly contribute to the energy with which electrons arrive at the anode, most of which is the kinetic energy with which the electrons leave the front surface 44. However, for a similarly configured field emitter having boron-doped CVD diamond as the emitter material, at the exemplary current value just mentioned, the average electric field strength is negligible across the cathode layer and about $2\times10^7$ V/m across the vacuum. For this field emitter, the current-voltage characteristic is a strong function of the anode-cathode spacing, as is shown in FIG. 6. Electrons leaving the emitter material by field emission have little kinetic energy, so the current is a strong function of the acceleration provided by the field across the vacuum.

The unique features of energetic-electron emitters of the invention make them suitable for application in a wide range of devices as replacements for thermionic or field-emission cathodes. One such example is a flat-panel display consisting of an array of emitters of the invention, each emitter corresponding to one pixel of the display, facing a video screen so that the electrons leaving the emitter strike the screen, with or without a voltage imposed between the emitter array and the screen. The individual emitters may be distinct devices, or preferably, independently addressed regions of a single expanse of the layered structure shown in the figures. Addressing schemes for such matrix-organized multiple cathodes are well-known in flat-panel technologies (see, e.g., R. Mach, "Thin-film electroluminescence devices" in *Solid State Luminescence,* A. Kitai, ed. [1993]).

Figure 7:
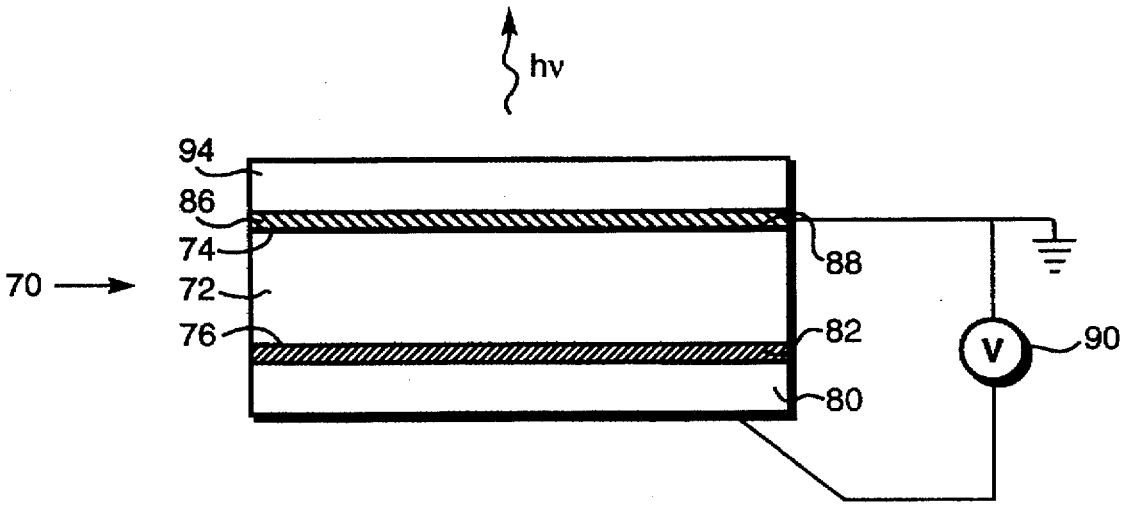
FIG. 7 schematically depicts a light-emitting device of the invention.

Furthermore, the invention provides light-emitting devices that do not require the evacuated space that conventionally separates the electron emitter from the phosphor material by incorporating the energetic-electron emitter structure of FIG. 1. With reference to FIG. 7, a flat-panel light-emitting device of the invention, generally designated at 70, includes a layer 72 of cathode material having a front surface 74 and a back surface 76. The layer 72 is in contact with a back electrode 80 at a back interface 82 and with a front electrode 86 at a front interface 88. A voltage source 90 contacts the back and front electrodes 80 and 86 so as to allow the imposition of a potential difference between them. The attributes of the layer 72, the back and front electrodes 80 and 86 and the back interface 82 correspond to those, already described, of the layer, back and front electrodes and back interface shown in FIG. 1 and respectively designated 12, 20, 26 and 22. Considerations analogous to those already discussed for the voltage source designated 30 are relevant to configuration of the voltage source 90. A layer 94 of phosphor material, such as, for example, zinc oxide is disposed over the front electrode 86. In operation, electrons leave the layer 72 as already described and enter the layer 94, without emission to vacuum, thereby exciting the phosphor material to luminescence. With appropriate constitution of the layer 94, several of the light-emitting devices 70, organized into a matrix array, constitute a flat-panel display.

In another embodiment, a light-emitting device comprises particles of the cathode material, with conductive contacts on their surfaces, and of the phosphor materials arranged in an intimate mixture held in a light-transmissive container with two electrodes. A voltage is applied across the mixture at the electrodes so as to impose average electric fields of about $10^5$ to $10^{10}$ V/m across the cathode particles. Energetic electrons leave the cathode material and enter the phosphor material, causing it to emit light, which is transmitted out of the container.

Any of several techniques are applicable to fabrication of the emitters of the invention. Most of the design variation concerns the fabrication of the front and back electrodes and their contact to the cathode material. Although the order of assembly of the elements is not crucial, the formation of the back electrode and its attachment to the emitter material to form the back contact are generally relatively disruptive and thus are executed before formation of the front electrode, especially if the device uses a rough back contact, as described below.

Techniques for physical deposition of conductive material may be employed for making the front electrode. For example, a thin metallic coating, such as a 10-nm gold layer, deposited by sputtering onto the front surface of the cathode material, forms a serviceable front electrode. In the case of diamond cathode material, ion bombardment of the emitter material front surface by xenon ions graphitizes the surface sufficiently to provide a thin transparent conductive layer that functions especially well as a front electrode. Bombardment by ions of much lower energy than is conventionally used for ion implantation—less than 20 keV—provides enough surface reconstruction to form a serviceable front electrode. For example, a 0.1 to 1 mA $cm^{-2}$ current of 1000-eV $Xe^+$ for about one to ten minutes creates a front electrode without requiring any heating of the diamond.

One effective method of forming the back electrode/emitter layer interface is by application of a treatment substance containing one or more metallic elements to the cathode material and annealing in a reducing environment, especially an environment containing hydrogen. This process results in a roughened back contact between the cathode material and a conductive material which functions as the back electrode. If the treatment substance is annealed in contact also with a device substrate, the process additionally adheres and electrically couples the emitter material to a device substrate which provides mechanical support and facilitates connection of the back electrode to the voltage source.

Such a roughened back interface can be formed with diamond cathode material by treatment with metals that dissolve diamond or with their compounds. These include the iron triad, the lanthanides, and titanium. For example, nickel in the solid or liquid phase etches diamond and deposits the equilibrium form of carbon, namely, graphite. If then exposed to hydrogen at high temperature, the deposited graphite is removed by nickel-catalyzed formation of methane. Because the hydrogen-carbon-nickel system exhibits a eutectic, the reaction can occur at temperatures below the melting point of nickel. Similar results can by achieved by use of nickel compounds. For example, examination by scanning electron microscopy shows that diamond-nickel interfaces formed by heating nickel acetylacetonate hydrate to about 1000° C. on diamond in the presence of 1% to 2% hydrogen gas in argon for a few seconds to several minutes have a surface topography characterized by a radius of curvature less than or equal to 10 nm. In the back contact of an emitter, this morphology promotes electron injection from the back electrode material into nitrogen-doped diamond. The emitter performance is especially good when the heating environment also includes water vapor or mist. Other nickel salts, such as the sulfate and chloride, also give rise to the desired interface geometry with similar treatment.

To use this technique with a CVD diamond film preformed on a deposition substrate, a nickel salt is deposited onto the CVD diamond surface. The structure is annealed in a reducing atmosphere. Additional nickel or copper is optionally deposited onto the nickel metal left behind by the etching operation. The deposition substrate is removed from the CVD layer by exposure to a sulfur hexafluoride plasma or a hydrogen fluoride-nitric acid solution in order to expose the front surface of the layer of cathode material for use or any required subsequent processing, such as construction of the front electrode. Electrical contact between the emitter and the remainder of the device circuit is made at the metal-plated surface.

A second technique for forming a roughened back contact in emitters constructed according to the invention uses conventional semiconductor dry etching techniques. For example, a masking material that is etched more slowly by the etching method than is the cathode material is deposited onto the surface of the emissive semiconductor to mask at least part of the exposed surface of the cathode material. For heightened surface relief the masking material can be patterned before etching using, for example, a standard integrated circuit lithography technique such as photoresist with wet chemical etching. The semiconductor is etched using a conventional dry anisotropic etching procedure, wherein the cathode material is etched more rapidly normal to than laterally into regions covered by masking material. As the mask is eroded, small regions of the diamond are exposed and begin to be etched. When the mask material has been removed completely, the resulting surface of the cathode material is irregular. The back contact is completed by, for example, sputtering or evaporative application of a thin coating of a metal showing good adhesion to the cathode material. A thicker layer of a compatible structural metal is optionally deposited over the thin metal coating.

For diamond cathode material, aluminum is one suitable mask material. Gaseous nitrogen dioxide with a xenon-ion beam provides an effective anisotropic etchant; the nitrogen dioxide reacts with the diamond to form carbon monoxide and carbon dioxide when catalyzed by the energetic ions (see, e.g., Efremow et al., *J. Vac. Sci. Technol. B*, 3(1), 416–8 [1985]). Aluminum, nickel, titanium, gold and tungsten are appropriate metals for deposition onto the etched surface. For wide-bandgap nitrides, such as those of boron, aluminum, gallium or indium, chlorine gas, with the formation of nitrogen gas and the volatile trichloride of the group 3*a* element, instead of the nitrogen dioxide is efficacious. Silicon carbide can be etched in a plasma of species containing fluorine.

Figure 8A:
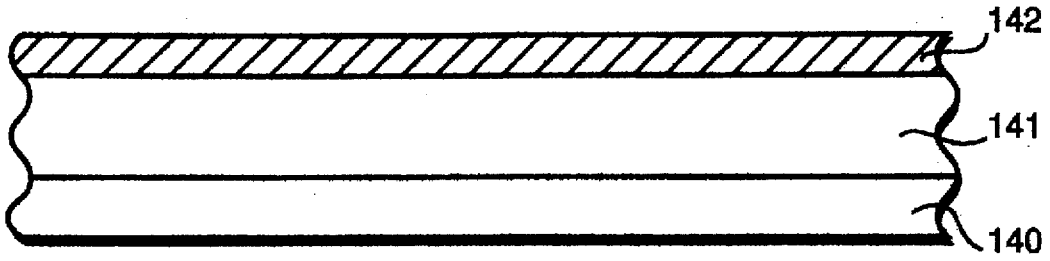
FIGS. 8A, 8B, 8C, 8D, and 8E are enlarged elevations that illustrate the fabrication of an emitter having a metal/diamond back contact formed using conventional semiconductor etching techniques, representing steps in part of an inventive process for fabricating the electron-emitting structure of the device.
Figure 8B:
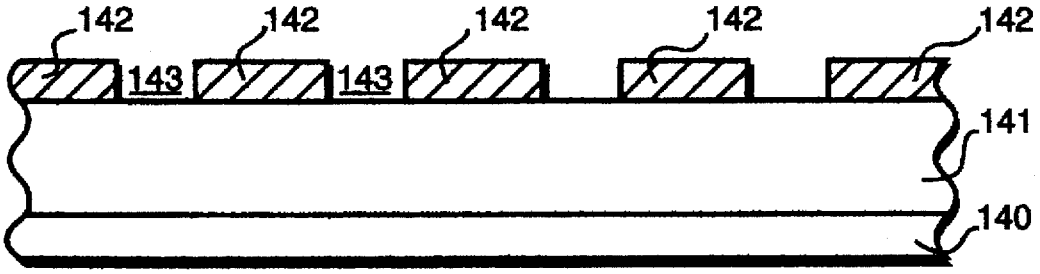
Figure 8C:
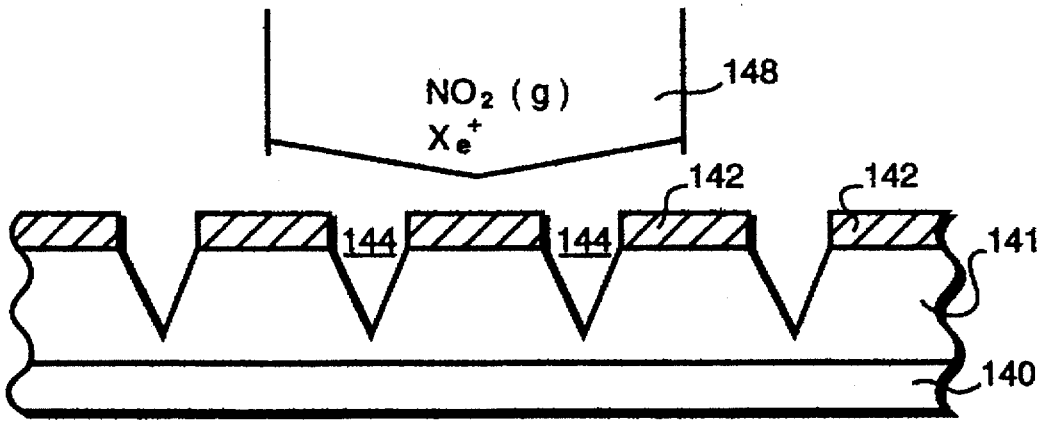
Figure 8D:
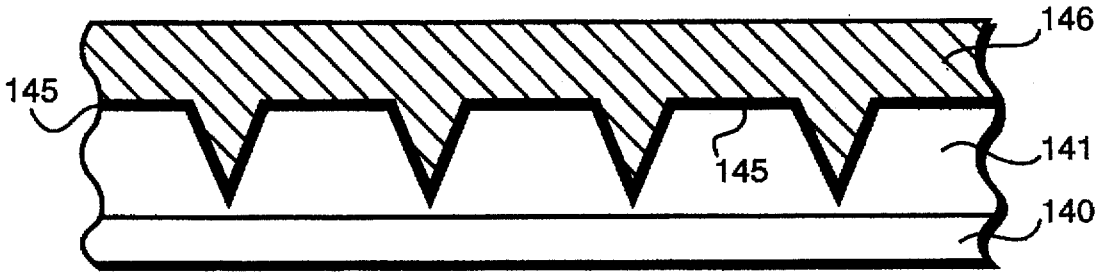
Figure 8E:
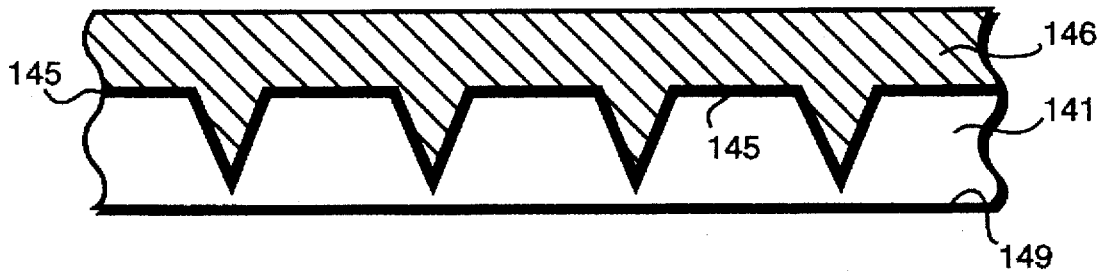

In one such process a structure, such as is shown in FIG. 8A, is made of a layer of type-Ib diamonds 141 having average thickness 0.1 to 2 mm attached using adhesive to a smooth carrier substrate 140 and then coated with 100 nm of electron-beam-evaporated aluminum 142. An array of circular holes 143 having diameter ~5 μm, shown in FIG. 8B, is patterned into the aluminum layer 142 using photoresist and wet chemical etching. FIG. 8C shows a flux 148 comprising a Xe+ ion beam of 1 keV and nitrogen dioxide directed toward the patterned surface. The resultant etching of the exposed diamond 141 continues until the aluminum 142, etched at a rate equal to approximately 1% of the diamond etch rate, is completely removed. The process excavates conical holes 144, each ~1 to 50 μm deep. FIG. 8D shows metal layers 145 and 146 applied to the etched diamond surface: a thin coating of nickel 145, constituting the rough back interface, covered by additional nickel is plated to form a structural layer 146 thicker than 100 μm. The adhesive is dissolved to remove the carrier substrate 140 from the diamond and thereby expose the front surface of the diamond 149, as shown in FIG 8E, for use or any required subsequent processing, such as construction of the front electrode. Electrical contact to the emitter was made at the surface of the metal layer 146. Such a process is also compatible with cathode material provided as a continuous film.

A third approach to forming a roughened back contact in emitters constructed according to the invention uses ion bombardment to disrupt the structure of the back surface of the emitter. After the surface region of the emitter material has been sufficiently altered by ion collisions, the back contact is formed by deposition of a metal layer, as described above. Conventional ion implantation, which uses ions having mean energy in excess of 20 keV and as high as 1000 keV, of carbon ions into diamond produces a damaged surface at which the back contact is then completed. Suitable ion bombardment techniques have been described for diamond films in published PCT Application WO93/15523.

Figure 9A:
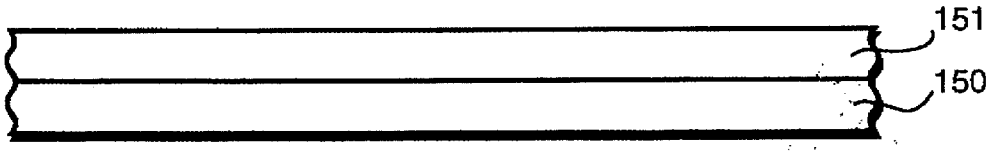
FIGS. 9A, 9B, 9C, and 9D are enlarged elevations that illustrate the fabrication of an emitter having a metal/diamond back contact formed using ion implantation, representing steps in part of an inventive process for fabricating the electron-emitting structure of the device.
Figure 9B:
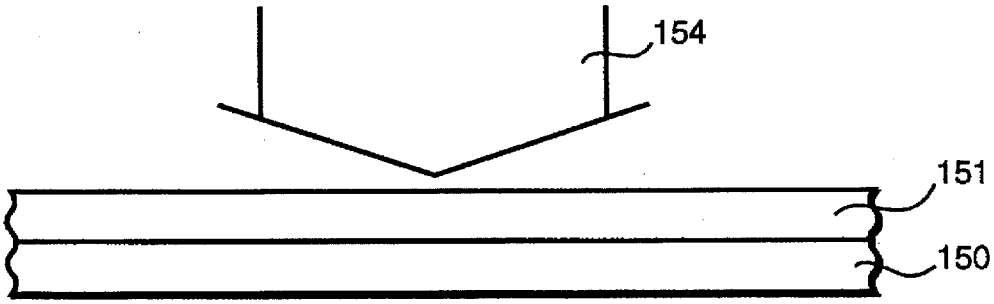
Figure 9C:
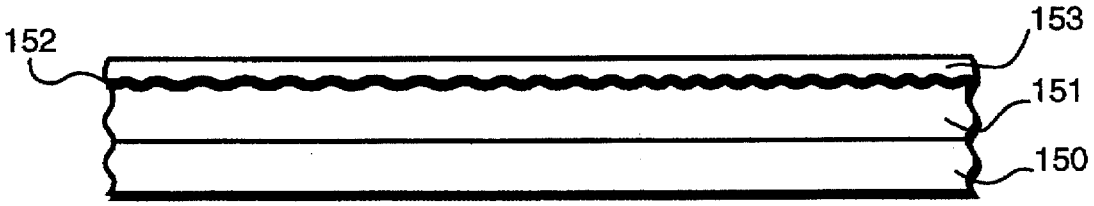
Figure 9D:
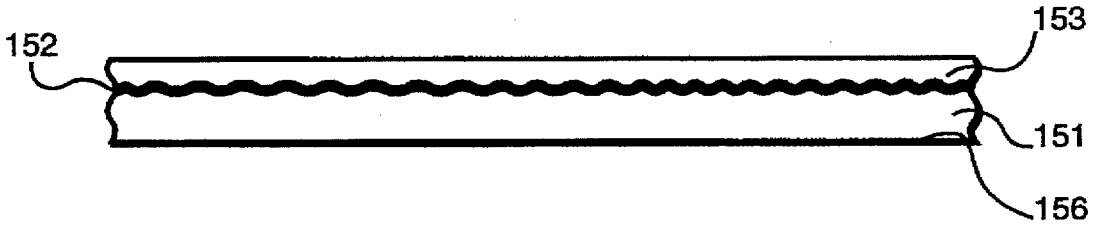

In one such process, a structure, such as is shown in FIG. 9A, is made of a diamond layer 151 attached using adhesive to a smooth carrier substrate 150. The structure is heated to about 350° C. and then, as indicated in FIG. 9B, subjected to a current density of about $10^{-5}$ A $cm^{-2}$ of carbon ions 154 with ion energies of about 50 to 170 keV and ion fluence of $3\times10^{16}$ $cm^{-2}$ to $4\times10^{16}$ $cm^{-2}$. The resultant surface is coated with 1 μm of electron-beam evaporated aluminum 152 to form the rough back interface followed by an additional aluminum layer 153 more than 100 μm thick, as shown in FIG. 9C. The adhesive is dissolved to remove the carrier substrate 150 from the diamond and thereby expose the front surface of the diamond 156, as shown in FIG. 9D for any required subsequent processing, such as construction of the front electrode. Electrical contact to the emitter is made at the surface of the metal layer 153.

Bombardment by ions of much lower energy than is used for ion implantation, in a process similar to that described above for forming the front electrode, also modifies the back emitter surface favorably for formation of a back contact with efficient electron injection. Bombardment of diamond by xenon ions, for example, at mean ion energies lower than 5 keV and as low as 1 keV, followed by deposition of metal, results in serviceable back contacts.

It will therefore be seen that the foregoing represents a highly advantageous structure for energetic electron emitters. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. An electron-emissive device comprising:

a. a cathode body of diamond, the body having a surface with first and second locations separated by a thickness;

b. first and second conductive materials disposed respectively on the first and second locations; and c. a voltage source, electrically connected to the cathode body by means of the first and second conductive materials so as to impose a body electric field having a body average amplitude greater than $10^5$ V/m across the thickness, the imposition of the body electric field causing the cathode body to emit electrons having kinetic energies.

2. The device of claim 1 wherein the voltage source imposes a dc electric field.

3. The device of claim 1 wherein the thickness is at least 10 μm.

4. The device of claim 1 wherein the thickness is at least 100 μm.

5. The device of claim 1 wherein the thickness is on the order of 1 mm.

6. The device of claim 1 wherein the diamond contains substitutional nitrogen.

7. The device of claim 6 wherein the substitutional nitrogen is present at a concentration equal to at least $10^{18}$ $cm^{-3}$.

8. The device of claim 1 wherein the diamond is type Ib diamond.

9. The device of claim 1 wherein the diamond is in the form of a film.

10. The device of claim 1 wherein the diamond is a single crystal.

11. The device of claim 1 wherein the first conductive material is disposed on the first location with an interface having a roughness characterized by a radius of curvature less than 15 nm between the cathode body surface and the first conductive material.

12. The device of claim 1 wherein the body average amplitude of the body electric field is greater than $10^6$ V/m.

13. The device of claim 1 wherein the body average amplitude of the body electric field is greater than $10^7$ V/m.

14. The device of claim 1 wherein the body average amplitude of the body electric field is greater than $10^8$ V/m.

15. The device of claim 1 wherein upon emission from the cathode body, electrons have kinetic energies of at least 50 eV.

16. The device of claim 1 wherein upon emission from the cathode body, electrons have kinetic energies of at least 200 eV.

17. The device of claim 1 wherein upon emission from the cathode body, electrons have kinetic energies of at least 500 eV.

18. The device of claim 1 wherein upon emission from the cathode body, electrons have kinetic energies equal to at least 10% of the energy corresponding to completely loss-free acceleration of an electron through the imposed body electric field across the thickness.

19. The device of claim 1 wherein upon emission from the cathode body, electrons have kinetic energies equal to at least 40% of the energy corresponding to completely loss-free acceleration of an electron through the imposed body electric field across the thickness.

20. The device of claim 1 further comprising phosphor material arranged to receive emitted electrons, thereby being excited to emit light.

21. The device of claim 1 further comprising an anode opposing the cathode body across an expanse of vacuum and a second voltage source coupled to the anode so as to impose a vacuum electric field having a vacuum average amplitude across the expanse of vacuum.

22. The device of claim 21 wherein the vacuum average amplitude is smaller than the body average amplitude of the body electric field imposed across the thickness of the cathode body.

23. The device of claim 22 wherein the vacuum electric field accelerates emitted electrons toward the anode, thereby increasing their kinetic energies by an increment, the increment being less than four times the kinetic energies of electrons upon emission from the cathode body.

24. The device of claim 1 wherein the body average amplitude of the body electric field is greater than $10^9$ V/m.

25. The device of claim 1 wherein the average field strength of the electric field is greater than $10^{10}$ V/m.

26. The device of claim 1 wherein the second conductive material is carbonaceous.

27. The device of claim 1 wherein the emitted electrons leave the cathode body at one of the first and the second locations.

28. The device of claim 1 further comprising an emission-enhancing material disposed on the surface, the emitted electrons leaving the cathode body through the emission-enhancing material.

29. The device of claim 1 the second conductive material is graphite.

30. An electron-emissive device comprising:

a. a cathode body of diamond, the body having a surface with first and second locations separated by a thickness;

b. first and second conductive materials disposed respectively on the first and second locations;

c. a phosphor material in intimate contact with the cathode body; and d. a voltage source, electrically connected to the cathode body by means of the first and second conductive materials so as to impose a body electric field having a body average amplitude greater than $10^5$ V/m across the thickness, the imposition of the body electric field causing electrons having kinetic energies to leave the cathode body and enter the phosphor material.

31. The device of claim 30 wherein the phosphor material is disposed on the second conductive material so that electrons enter the phosphor material directly from the first conductive material, without passing through vacuum.

32. An electron-emissive device comprising:

a. a cathode body of diamond, the body having a thickness;

b. an anode opposing the cathode body across an expanse of vacuum; and c. a voltage source, coupled to the cathode body and to the anode so as to impose a body electric field, having a body average amplitude greater than $10^5$ V/m, across the thickness and a vacuum electric field, having a vacuum average amplitude smaller than the body average amplitude, across the expanse of vacuum, the imposition of the body electric field causing the cathode body to emit into the vacuum electrons having kinetic energies.

33. The device of claim 32 wherein the voltage source imposes a dc electric field.

34. The device of claim 32 wherein the thickness is at least 10 μm.

35. The device of claim 32 wherein the thickness is at least 100 μm.

36. The device of claim 32 wherein the thickness is on the order of 1 mm.

37. The device of claim 32 wherein the diamond contains substitutional nitrogen.

38. The device of claim 37 wherein the substitutional nitrogen is present at a concentration equal to at least $10^{18}$ $cm^{-3}$.

39. The device of claim 32 wherein the diamond is type Ib diamond.

40. The device of claim 32 wherein the diamond is in the form of a film.

41. The device of claim 32 wherein the diamond is a single crystal.

42. The device of claim 32 wherein the cathode body has a surface and further comprising a conductive material disposed on the surface with an interface having a roughness characterized by a radius of curvature less than 15 nm between the surface and the conductive material, the voltage source electrically contacting the cathode body by means of the conductive material.

43. The device of claim 32 wherein the body average amplitude of the body electric field is greater than $10^6$ V/m.

44. The device of claim 32 wherein the body average amplitude of the body electric field is greater than $10^7$ V/m.

45. The device of claim 32 wherein the body average amplitude of the body electric field is greater than $10^8$ V/m.

46. The device of claim 32 wherein upon emission from the cathode body, electrons have kinetic energies of at least 50 eV.

47. The device of claim 32 wherein upon emission from the cathode body, electrons have kinetic energies of at least 200 eV.

48. The device of claim 32 wherein upon emission from the cathode body, electrons have kinetic energies of at least 500 eV.

49. The device of claim 32 wherein upon emission from the cathode body, electrons have kinetic energies equal to at least 10% of the energy corresponding to completely loss-free acceleration of an electron through the imposed body electric field across the thickness.

50. The device of claim 32 wherein upon emission from the cathode body, electrons have kinetic energies equal to at least 40% of the energy corresponding to completely loss-free acceleration of an electron through the imposed body electric field across the thickness.

51. The device of claim 32 further comprising phosphor material arranged to receive emitted electrons, thereby being excited to emit light.

52. The device of claim 51 wherein the phosphor material is disposed on the anode.

53. The device of claim 32 wherein the vacuum electric field accelerates emitted electrons toward the anode, thereby increasing their kinetic energies by an increment, the increment being less than four times the kinetic energies of electrons upon emission from the cathode body.

54. The device of claim 32 wherein the body average amplitude of the body electric field is greater than $10^9$ V/m.

55. The device of claim 32 wherein the body average amplitude of the body electric field is greater than $10^{10}$ V/m.

56. The device of claim 32 wherein the cathode body has a surface and further comprising an emission-enhancing material disposed on the surface, the emitted electrons leaving the cathode body through the emission-enhancing material.

57. An electron-emissive device comprising:

a. a cathode body having a thickness equal to at least 100 μm;

b. a voltage source; and c. means for coupling the voltage source to the cathode body so as to impose a body electric field having a body average amplitude across the thickness, imposition of the body electric field causing the cathode body to emit electrons having kinetic energies equal to at least 10% of the energy corresponding to completely loss-free acceleration of an electron through the imposed body electric field across the thickness.

58. The device of claim 57 wherein imposition of the electric field causes the cathode body to emit electrons having kinetic energies equal to at least 40% of the energy corresponding to completely loss-free acceleration of an electron through the imposed body electric field across the thickness.

59. The device of claim 58 wherein the thickness is on the order of 1 mm.

60. The device of claim 58 wherein the body average amplitude over the thickness is between $10^5$ V/m and $10^{10}$ V/m.

61. The device of claim 58 wherein the body average amplitude over the thickness is between $10^5$ V/m and $10^9$ V/m.

62. The device of claim 57 wherein the voltage source is configured to impose an accelerating electric field on the electrons upon their emission from the cathode body.

63. The device of claim 62 wherein the accelerating electric field accelerates emitted electrons, thereby increasing their kinetic energies by an increment, the increment being less than four times the kinetic energies of electrons upon emission from the cathode body.

64. The device of claim 57 wherein the cathode body is of a wide-bandgap semiconductor.

65. The device of claim 57 wherein the cathode body is of a group III nitride.

66. The device of claim 57 wherein the cathode body is of silicon carbide.

67. The device of claim 57 wherein the thickness is on the order of 1 mm.

68. The device of claim 57 wherein the voltage source imposes a dc electric field.

69. The device of claim 57 wherein the cathode body has a surface and further comprising a conductive material disposed on the surface with an interface having a roughness characterized by a radius of curvature less than 15 nm between the cathode body surface and the conductive material, the voltage source electrically contacting the cathode body by means of the conductive material.

70. The device of claim 57 wherein the cathode body has a surface and further comprising an emission-enhancing material disposed on the surface, the emitted electrons leaving the cathode body through the emission-enhancing material.

71. The device of claim 57 further comprising phosphor material arranged to receive emitted electrons, thereby being excited to emit light.

72. The device of claim 71 wherein the phosphor material is in intimate contact with the cathode body so that the emitted electrons enter the phosphor material directly from the cathode body.

73. The device of claim 57 wherein the cathode body is of diamond.

74. The device of claim 73 wherein the cathode body is type Ib diamond.

75. The device of claim 57 wherein the body average amplitude over the thickness is less than $10^9$ V/m.

76. The device of claim 75 wherein the body average amplitude over the thickness is greater than $10^5$ V/m.

77. The device of claim 57 wherein the body average amplitude over the thickness is less than $10^7$ V/m.

78. The device of claim 77 wherein the body average amplitude over the thickness is greater than $10^5$ V/m.

79. The device of claim 57 wherein imposition of the body electric field causes the cathode body to emit electrons having kinetic energies of at least 50 eV.

80. The device of claim 79 wherein the thickness is on the order of 1 mm.

81. The device of claim 57 wherein the body average amplitude over the thickness is less than $10^{10}$ V/m.

82. The device of claim 81 wherein the body average amplitude over the thickness is greater than $10^5$ V/m.

83. The device of claim 57 wherein the body average amplitude over the thickness is less than $10^8$ V/m.

84. The device of claim 83 wherein the body average amplitude over the thickness is greater than $10^5$ V/m.

85. The device of claim 57 wherein the body average amplitude over the thickness is less than $10^6$ V/m.

86. The device of claim 85 wherein the body average amplitude over the thickness is greater than $10^5$ V/m.

87. An electron-emissive device comprising:

a. a cathode body having a thickness equal to at least 100 μm;

b. a voltage source; and c. means for coupling the voltage source to the cathode body so as to impose a body electric field having a body average amplitude across the thickness, imposition of the body electric field causing the cathode body to emit electrons having kinetic energies of at least 50 eV.

88. The device of claim 87 wherein imposition of the electric field causes the cathode body to emit electrons having kinetic energies equal to at least 40% of the energy corresponding to completely loss-free acceleration of an electron through the imposed body electric field across the thickness.

89. The device of claim 87 wherein the thickness is on the order of 1 mm.

90. The device of claim 87 wherein the cathode body is of diamond.

91. The device of claim 90 wherein the cathode body is type Ib diamond.

92. The device of claim 87 wherein the cathode body is of a wide-bandgap semiconductor.

93. The device of claim 87 wherein the cathode body is of a group III nitride.

94. The device of claim 87 wherein the cathode body is of silicon carbide.

95. The device of claim 87 wherein the voltage source is configured to impose an accelerating electric field on the electrons upon their emission from the cathode body.

96. The device of claim 95 wherein the accelerating electric field accelerates emitted electrons, thereby increasing their kinetic energies by an increment, the increment being less than four times the kinetic energies of electrons upon emission from the cathode body.

97. The device of claim 87 wherein the voltage source imposes a dc electric field.

98. The device of claim 87 wherein the cathode body has a surface and further comprising a conductive material disposed on the surface with an interface having a roughness characterized by a radius of curvature less than 15 nm between the cathode body surface and the conductive material, the voltage source electrically contacting the cathode body by means of the conductive material.

99. The device of claim 87 wherein the cathode body has a surface and further comprising an emission-enhancing material disposed on the surface, the emitted electrons leaving the cathode body through the emission-enhancing material.

100. The device of claim 87 further comprising phosphor material arranged to receive emitted electrons, thereby being excited to emit light.

101. The device of claim 100 wherein the phosphor material is in intimate contact with the cathode body so that the emitted electrons enter the phosphor material directly from the cathode body.

102. The device of claim 87 wherein the body average amplitude over the thickness is less than $10^{10}$ V/m.

103. The device of claim 102 wherein the body average amplitude over the thickness is greater than $10^5$ V/m.

104. The device of claim 87 wherein the body average amplitude over the thickness is less than $10^9$ V/m.

105. The device of claim 104 wherein the body average amplitude over the thickness is greater than $10^5$ V/m.

106. The device of claim 87 wherein the body average amplitude over the thickness is less than $10^8$ V/m.

107. The device of claim 106 wherein the body average amplitude over the thickness greater than $10^5$ V/m.

108. The device of claim 87 wherein the body average amplitude over the thickness is less than $10^7$ V/m.

109. The device of claim 108 wherein the body average amplitude over the thickness is greater than $10^5$ V/m.

110. The device of claim 87 wherein the body average amplitude over the thickness is less than $10^6$ V/m.

111. The device of claim 110 wherein the body average amplitude over the thickness is greater than $10^5$ V/m.

* * * * *